US006758737B2

(12) United States Patent
Svensson

(10) Patent No.: US 6,758,737 B2
(45) Date of Patent: Jul. 6, 2004

(54) COIN PROCESSING APPARATUS AND METHOD

(75) Inventor: Magnus Svensson, Lund (SE)

(73) Assignee: Scan Coin Industries AB, Malmö (SE)

( * ) Notice: Subject to any disclaimer, the term of this patent is extended or adjusted under 35 U.S.C. 154(b) by 219 days.

(21) Appl. No.: 10/152,018

(22) Filed: May 22, 2002

(65) Prior Publication Data

US 2003/0220064 A1 Nov. 27, 2003

(51) Int. Cl.[7] ..... G07D 9/00; G07D 9/06; B65B 9/00

(52) U.S. Cl. ..... 453/59; 53/450; 53/548

(58) Field of Search ..... 453/59, 63; 194/353; 221/22, 26, 33, 302; 209/1, 2; 53/450, 451, 453, 455, 456, 545, 548, 553, 555

(56) References Cited

U.S. PATENT DOCUMENTS

| | | | | | |
|---|---|---|---|---|---|
| 2,826,025 A | | 3/1958 | Swartz | | |
| 3,861,119 A | | 1/1975 | Taggart | | |
| 3,906,964 A | * | 9/1975 | Ushio et al. | ..... | 453/63 |
| 4,102,110 A | * | 7/1978 | Iizuka et al. | ..... | 53/493 |
| 4,123,892 A | * | 11/1978 | Asami | ..... | 53/54 |
| 4,215,524 A | | 8/1980 | Saylor | | |
| 4,383,541 A | * | 5/1983 | Uchida | ..... | 453/31 |
| 4,773,202 A | * | 9/1988 | Felts et al. | ..... | 53/429 |
| 5,435,777 A | * | 7/1995 | Takatani et al. | ..... | 453/31 |
| 6,499,277 B1 | * | 12/2002 | Warner et al. | ..... | 53/447 |

FOREIGN PATENT DOCUMENTS

| | | | | | |
|---|---|---|---|---|---|
| GB | 1364564 | | 8/1974 | | |
| GB | 2131766 | A | 6/1984 | | |
| JP | 3-14194 | A * | 6/1991 | ..... | G07G/1/00 |
| SE | 353872 | B | 2/1973 | | |
| SE | 511607 | C2 | 10/1999 | | |
| WO | WO 9933030 | | 7/1999 | | |
| WO | WO 0037317 | | 6/2000 | | |

* cited by examiner

*Primary Examiner*—Donald P. Walsh
*Assistant Examiner*—Mark J. Beauchaine

(57) ABSTRACT

A coin processing apparatus has an opening for receiving a plurality of coins of different types, a coin sensor adapted to determine a respective type of individual coins among the plurality of coins, a controller operatively coupled to the coin sensor, a coin separator operatively coupled to the controller and capable of separating the individual coins from the plurality of coins under control of the controller. Moreover, the apparatus has a coin packaging device comprising a coin inlet, a supply of packaging material and a packaging mechanism capable of producing a plurality of coin bags from the supply, so that at least two different coin types are packaged in the coin bags in a continuous operation.

15 Claims, 10 Drawing Sheets

COIN PROCESSING APPARATUS AND METHOD

TECHNICAL FIELD

The present invention relates to a coin processing apparatus, comprising an opening for receiving a plurality of coins of different types, a coin sensor adapted to determine a respective type of individual coins among the plurality of coins, a controller operatively coupled to the coin sensor, and a coin separator operatively coupled to the controller and capable of separating the individual coins from the plurality of coins under control from the controller. More specifically, the invention is directed at a coin packaging device in such a coin processing apparatus. The invention also relates to a coin processing method.

PRIOR ART

Coin packaging devices for performing quick and reliable packaging of coins are previously known. The packaging devices commonly perform packaging of the coins in bags in which a predetermined number of coins are filled. The devices that today exist on the market for packaging coins in paper or plastic bags are big and bulky.

Moreover, it is known to stack coins into piles, which are wrapped by a piece of paper or placed in a paper cylinder, which is sealed at its ends so as to form a paper tube containing a pile of coins.

GB-A-1 364 564 discloses an apparatus for forming bags of heat sealable packaging material, which then are filled with coins. The heat sealable packaging material is supplied as at least one web. The apparatus comprises means for forming a loop of the web or webs and a guide housing adapted to enclose the web or webs, fed thereto for shaping the web or webs into a tube. The apparatus further comprises swingers mounted on either sides of the web or webs of packaging material and formed in the guide housing, and supporting heat sealing jaws for transverse sealing of portions of the web or webs projecting from the guide housing at the lower end thereof.

WO 99/33030 discloses a coin counting and sorting device with active coin handling means. While coins in paper tubes are easy to handle and transport, paper tubes are less desirable for other reasons. For instance, paper as a packaging material is relatively expensive. Moreover, the fact that the coins are stacked in piles requires a complicated mechanical coin packaging device, which additionally generally suffers from a low operating speed. The apparatus in GB-A-1 364 564 complicates the storage of coin bags because when each coin bag is finally sealed, it is cut from the other bags and is delivered into another device. GB-A-1 364 564 does not contain any details of how such a coin packaging device may be incorporated in for example a self-service coin counting and/or sorting machine.

SUMMARY OF THE INVENTION

It is therefore an object of the present invention to provide a coin processing apparatus for sorting and/or counting coins with a subsequent packaging of the coins in plastic bags formed in an interconnected sequence with each other in a band, wherein the plastic bags filled with coins may be stored as the band or as separate plastic bags.

Additionally, it is an object of the invention to provide a high level of operational reliability and accuracy. Moreover, the invention aims at providing a coin processing apparatus that facilitates the subsequent handling of the bags filled with coins for human users.

The object is achieved by a coin processing apparatus having an opening for receiving a plurality of coins of different types. The apparatus further has a coin sensor adapted to determine a respective type of individual coins among the plurality of coins, a controller operatively coupled to the coin sensor, and a coin separator operatively coupled to the controller and capable of separating the individual coins from the plurality of coins under control from the controller. Moreover, the apparatus comprises a coin packaging device having: a coin inlet, a supply of packaging material, and a packaging mechanism capable of producing a plurality of coin bags from the supply. The coin inlet is coupled to the coin separator so as to receive the individual coins therefrom, the packaging mechanism is adapted to enclose the individual coins in any of the coin bags, and the controller is adapted to control the packaging mechanism according to a specified packaging scheme, so that at least two different coin types are packaged in the coin bags in a continuous operation.

Other objects, features and advantages will appear from the forthcoming detailed disclosure, from the drawings as well as from the appended patent claims.

BRIEF DESCRIPTION OF THE DRAWINGS

The present invention will now be described in more detail, reference being made to the enclosed drawings, in which.

DETAILED DISCLOSURE

Figure 1:
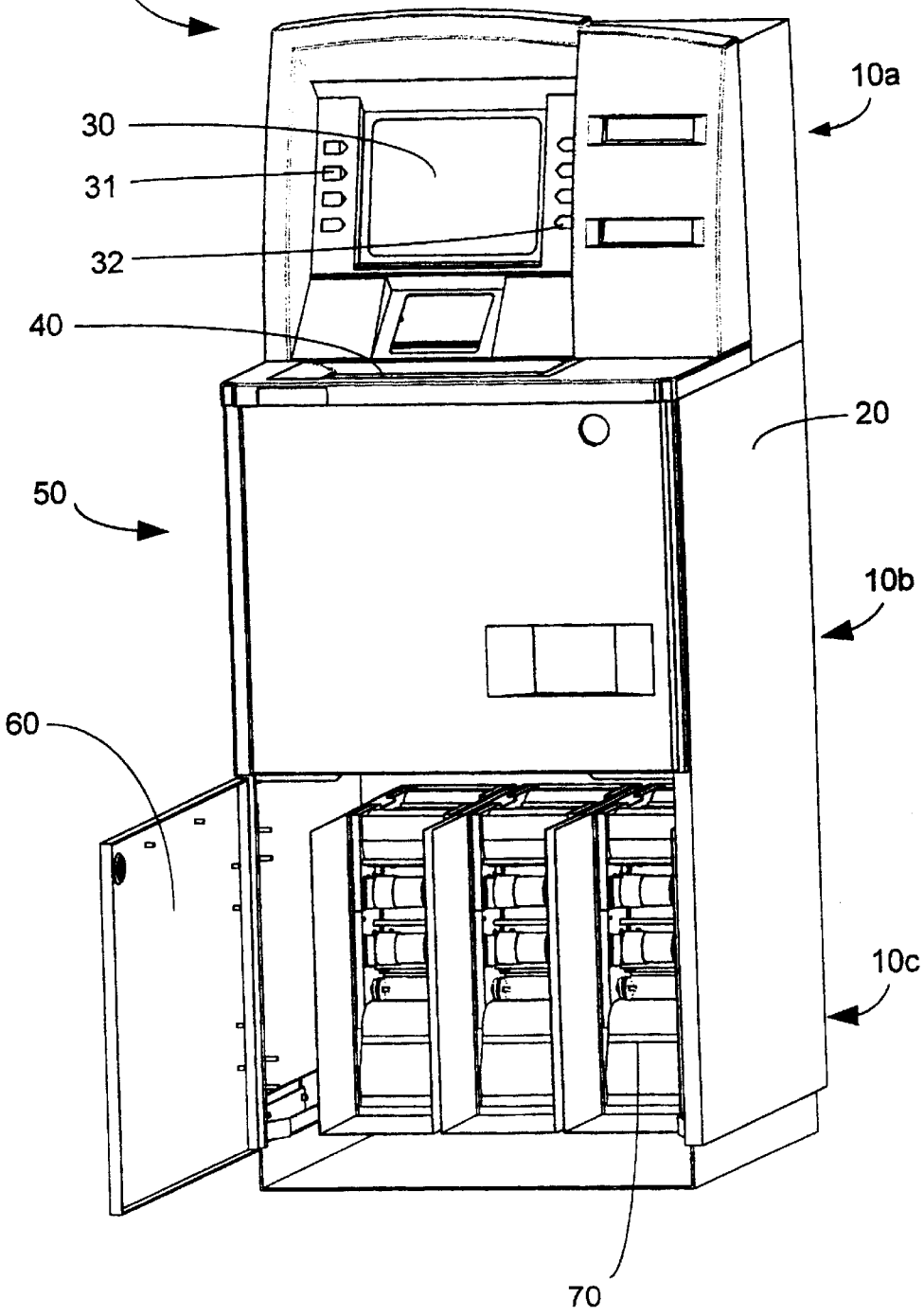
FIG. 1 is a perspective view of a coin processing apparatus according to the present invention.

FIG. 1 shows a coin processing apparatus 10 according to the present invention comprising a housing 20 and an user interface area 30 at its upper portion 10*a*, where a coin inlet 40 is placed. The apparatus also has a middle portion 10*b* in which a coin separator 50 (not shown in FIG. 1) is placed. The apparatus 10 further comprises at least one cover 60, here shown in an open position, for covering the interior of a lower portion 10*c* of the apparatus 10. The lower part 10*c* of the apparatus may contain different components with different functions, e g coin boxes only used for storing processed coins or, preferably, coin packaging devices 70. The coin processing apparatus 10 and more specific the coin separator 50 may be any kind of coin handling apparatus, e g a coin counting and/or sorting machine using active or passive coin handling means. The coin processing apparatus 10 may also be a coin handling machine for self-service in which coins may be deposited and/or collected by an user.

Figure 2:
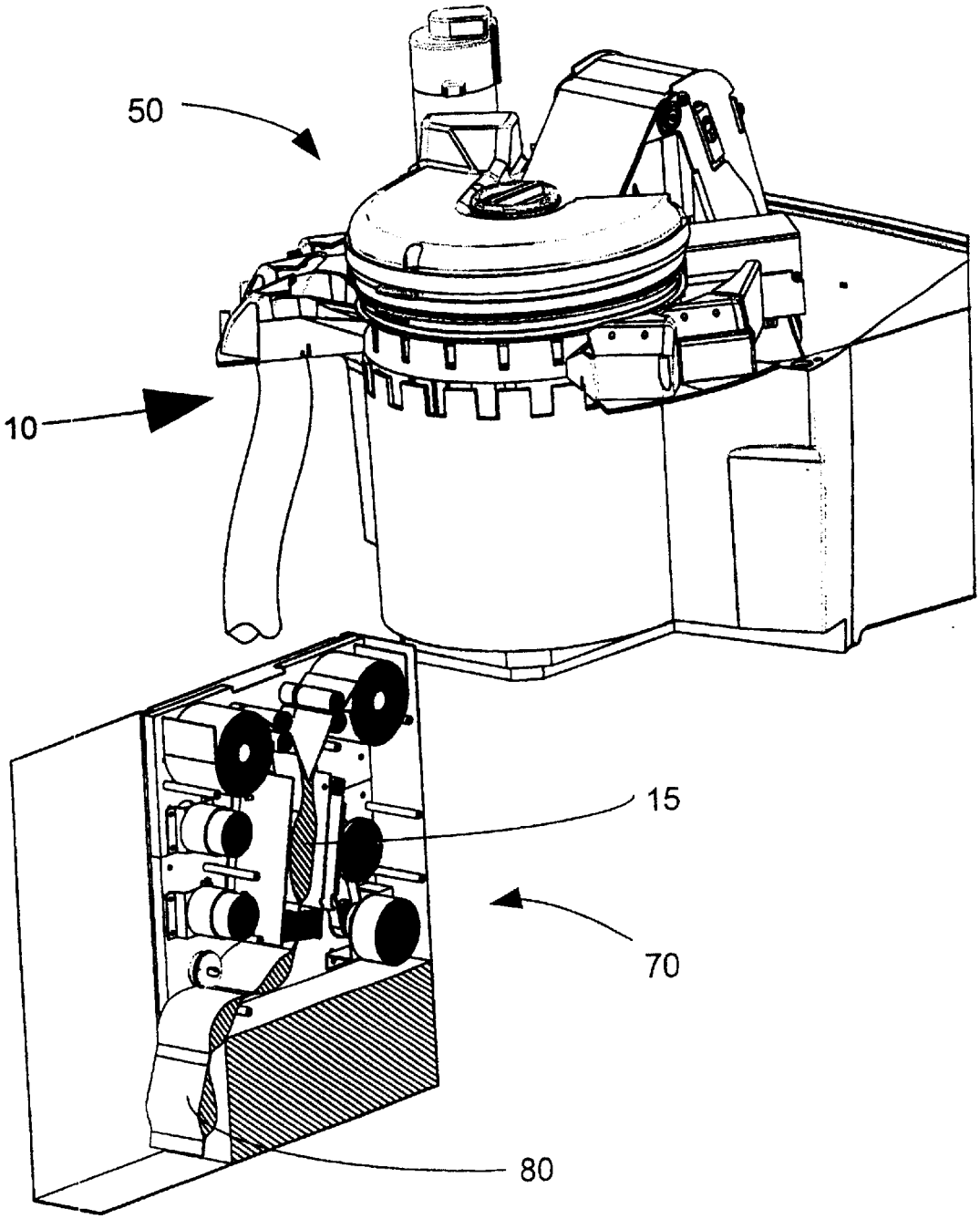
FIG. 2 is a perspective view of the main components inside the coin processing apparatus in FIG. 1.

In FIG. 2 two main components of the coin processing apparatus 10 are shown in a preferred embodiment. The top component is a perspective view of the coin separator 50 and the lower component is the coin packaging device 70, which is shown in a perspective view in section for clarity reasons, for packaging coins that are generally represented by the reference numeral 15 in batches 80.

Figure 3:
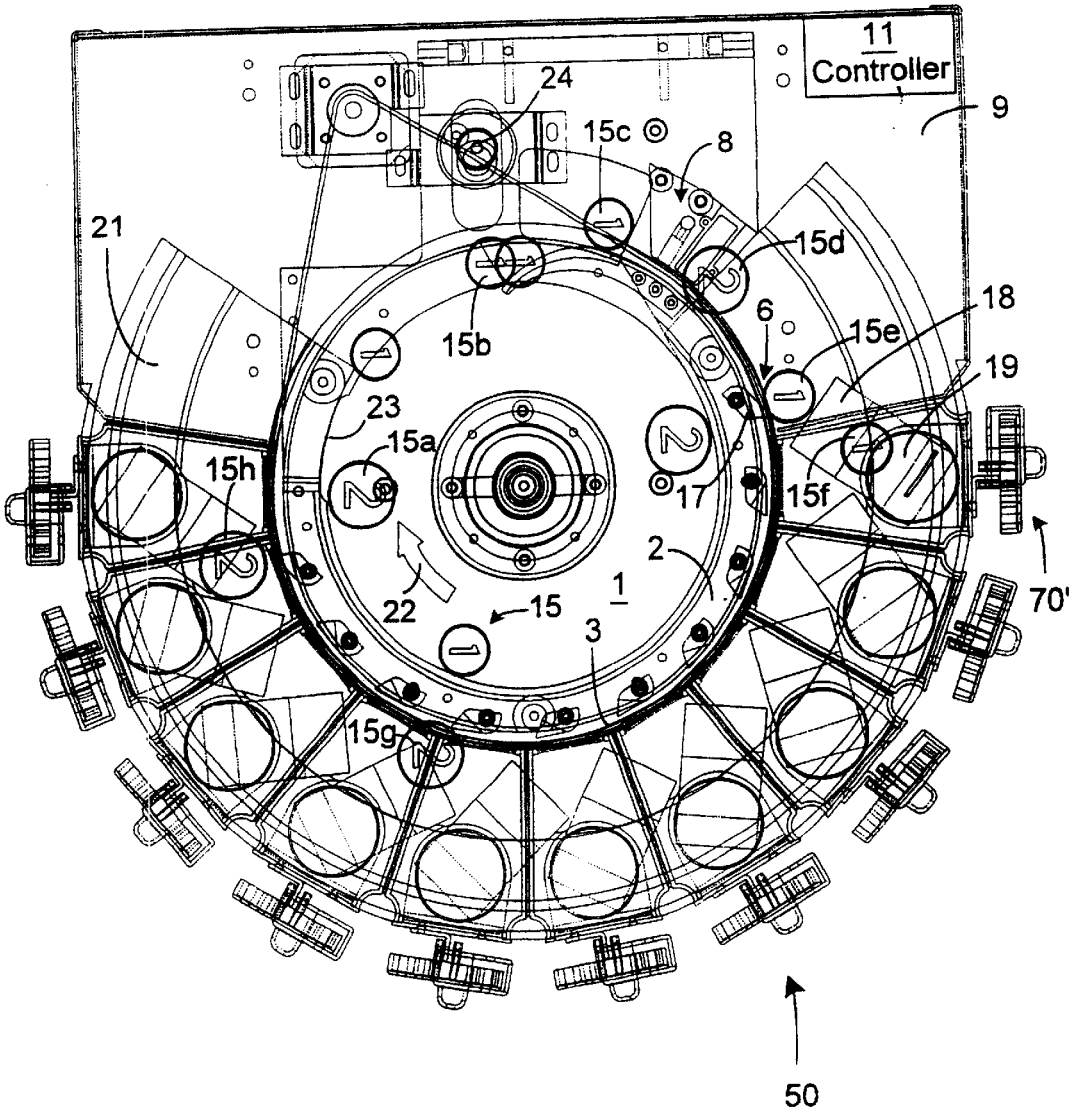
FIG. 3 is a top view of one of the main components inside the coin processing apparatus in FIG. 1.
Figure 4:
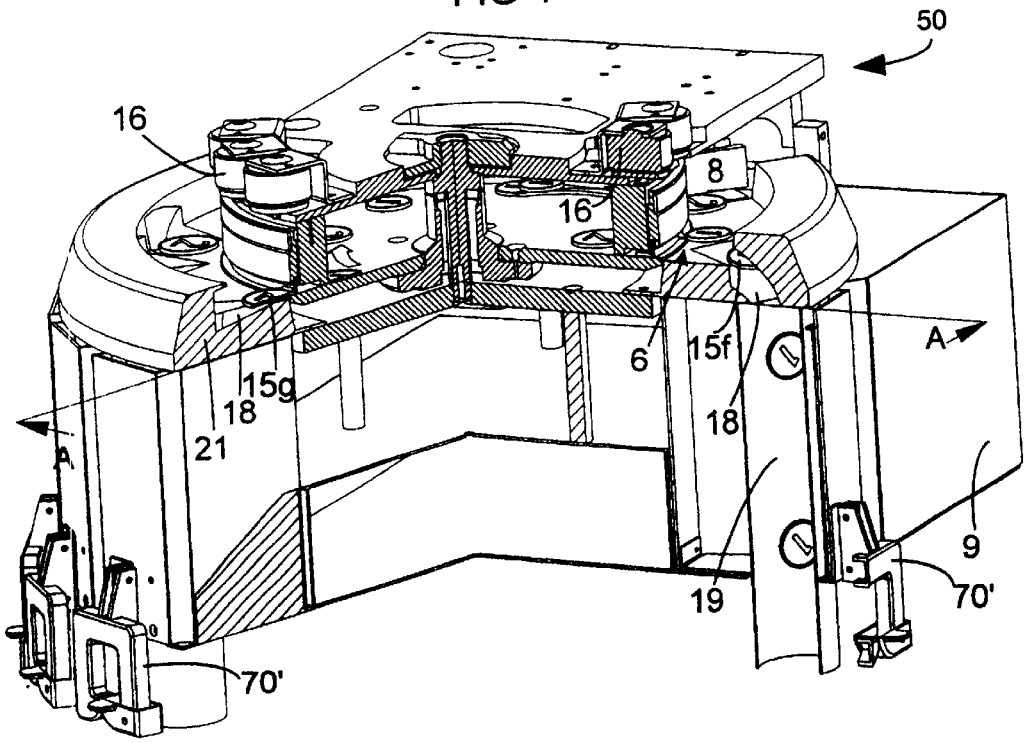
FIG. 4 is a perspective view of the main component in FIG. 3.
Figure 5:
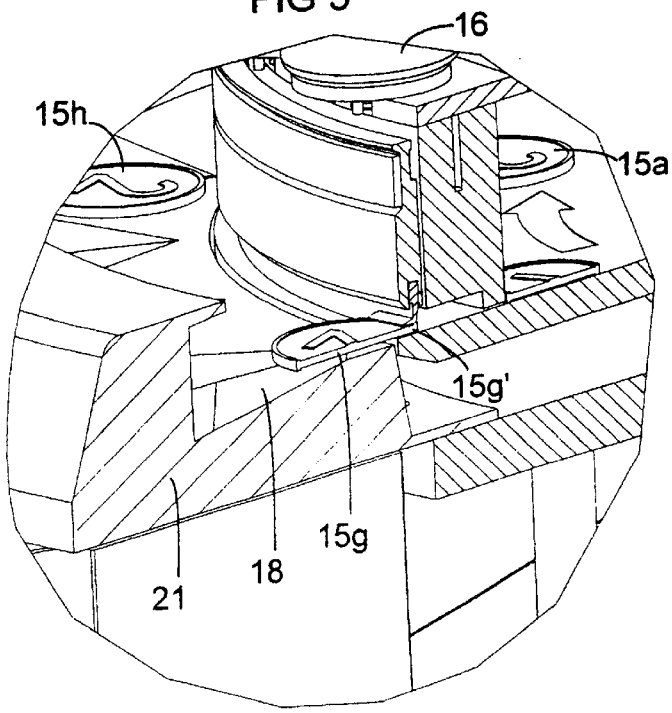
FIG. 5 is an enlarged perspective view of a portion of the main component in FIG. 4.

FIGS. 3–5 illustrate a preferred embodiment of the coin separator 50. One suitable separator in the form of a coin counter/sorter is described in e.g. WO99/33030, which is fully incorporated herein by reference. The coin separator handles a plurality of coins 15. Coins at specific positions in the coin separator are labelled 15*a*, 15*b*, etc., as will be described below.

As appears from FIGS. 3–5, the coin separator 50 comprises an apparatus frame 9, a plurality of coin chutes 18, 19 and corresponding coin receptacle attachments 70', which are all circularly arranged around the central components of the separator. The attachments 70' may support respective coin receptacles (not shown), which are adapted to receive and store coins that have been processed by the separator, and which are of a different kind than plastic coin bags.

A first rotating disk 1 of the coin separator 50 is arranged to receive an unsorted plurality of coins 15 from e.g. a human user through the coin inlet 40. For reasons of clarity, only a few coins 15, 15*a* . . . 15*h* have been indicated in the drawings. In reality, the number of coins is considerably larger. As the disk 1 is rotated in a direction indicated by an arrow 22 in FIG. 3, the coins deposited onto the disk are accelerated by the centrifugal force in the radial direction of the disk towards a stationary ring 2, as indicated by 15*a* in FIG. 3. The plurality of coins are driven through an opening 23 in the stationary ring 2 and are forced into contact with the inside of a resilient rim 14 on a rotating ring 3 (see 15*b*).

FIG. 5 provides a detailed illustration of a coin 15*g*, which is engaged at a short portion 15*g*' thereof between the rim 14 and the disk 1. As appears from FIG. 3, the coin 15*g* has been carried approximately 180° around its circular path starting from the point of engagement at 15*c*. Coins of small diameter (as seen at 15*c* and 15*e*) as well as coins of a larger diameter (as seen at 15*d* and 15*g*) may be freely engaged and transported between the rim and the disk in the manner described above.

A coin sensor 8 is arranged to detect the passage of a respective coin 15*d* and to identify the denomination or type thereof. The coin sensor 8 may operate in a contactless manner known per se in the technical field, such as by inductive or optical means, as is readily realized by a man skilled in the art.

The coin separator 50 is provided with an encoder 24 for determining the rotational speed of the rotating disk 1 and the rotating ring 3. The encoder 24 as well as the coin sensor 8 are operatively connected to a controller 11 (shown in FIG. 3). The controller 11 is arranged to use information received from the encoder and the coin sensor 8 to determine the position of each coin 15*d*, 15*e*, 15*g* relative to the coin sensor 8 at different points in time. When the controller 11 has determined that the coin 15 has reached a correct off-sort station 6, the controller will activate a deflector unit 16, 17 located at each off-sort station.

Hence, the deflector 17 is arranged to push the respective coin 15 through the rim 14 and the rotating disk 1, so that the coin is released from the engagement between the rim and the disk. When a coin 15*f* has been released, it will fall into a respective coin chute 18, 19. As is best shown in FIG. 4, each coin chute comprises an upper portion 18 and a lower portion 19. The upper portion 18 has a downward slope, while the lower portion 19 runs essentially vertically. After having passed through the coin chute 18, 19, the coin 15*f* is deposited into the coin packaging device 70 through a coin guide 90, as will be described in more detail below.

The coin separator 50 shown in FIGS. 3–5 is incorporated in the coin processing apparatus 10 shown in FIG. 1. The coin processing apparatus may advantageously be used as a coin deposit machine on a self-service basis by an untrained user (e.g. a shop visitor, a bank customer, etc.), who may deposit a plurality of coins of mixed denominations and/or currencies, for instance originating from his pocket, wallet or savings-box. The coins are put by the user into the coin inlet or intake 40 in the apparatus 10, and then the user initiates the coin processing by pressing a start button or the like. The coin processing apparatus is arranged to count and/or sort the coins deposited by the user and provide a receipt or voucher in return. The receipt or voucher may be used as payment for articles offered in a shop. Alternatively, a bank account belonging to the user may be credited an amount corresponding to the total value of the coins.

Once the user has deposited some coins 15 in the coin inlet 40, the counting and/or sorting process is initiated. The process may be initiated by pressing any of a number of keys 31 or 32, shown in FIG. 1, or, alternatively, the process may be automatically initiated by a detector in the coin inlet 40. The coins are supplied to the upper surface of the coin separator 50, as described above. The coins are then sequentially transported by the ring 3 and the disk 1 around a circular sorting path. The coins are deflected at any of the off-sort stations 6 and fall one by one into respective coin chutes 18, 19.

As the coins 15 are processed by the coin separator 50, a value representing a total amount of the coins 15 is calculated by the controller 11 of the coin separator or by separate controller means, such as a computer or CPU with associated memory. Coins that are rejected by the coin separator are returned in a reject tray, which is accessible to the user. When the coin separator has processed all coins, a printer may provide a voucher or receipt. A total value is printed on the receipt, as described above. During all times, the user interface area 30 in the form of a monitor may be used for user interaction, e.g. for presenting guidance or informative messages to the user. The user may insert a credit card, a smart card or any other card-shaped information carrier through a card slot. A card reader inside the device is arranged to read information stored on the card and to act accordingly. For instance, the card may contain information regarding a bank account number to be credited, once the total amount of the coins has been determined.

The coin-handling device 50 is advanced and may sort or count any denomination or currency of coins 15, whereby the coins may be sorted out into the coin chutes 18 and 19 in any number and order. This means that different coin batches may be sorted out containing a different number, denomination or currency in each batch. These coin batches may then be received by the coin packaging device 70. More specifically, the coin processing device 10 may receive a first coin batch with a first type and number of coins, a second batch with a second type and number of coins, and a third batch with a third type and number of coins, etc, or a mixture of coin types in each batch. The coin packaging device 70 may then receive a first type and number of coins and a second type and number of coins to be packaged in the same first batch, a second type and number of coins and a third type and number of coins to be packaged in a second batch, and a third type and number of coins and a fourth type and number of coins to be packaged in a third batch, etc. The packaging device 70 may also package more than two types of coins in each batch, as is readily understood by a man skilled in the art.

Figure 6:
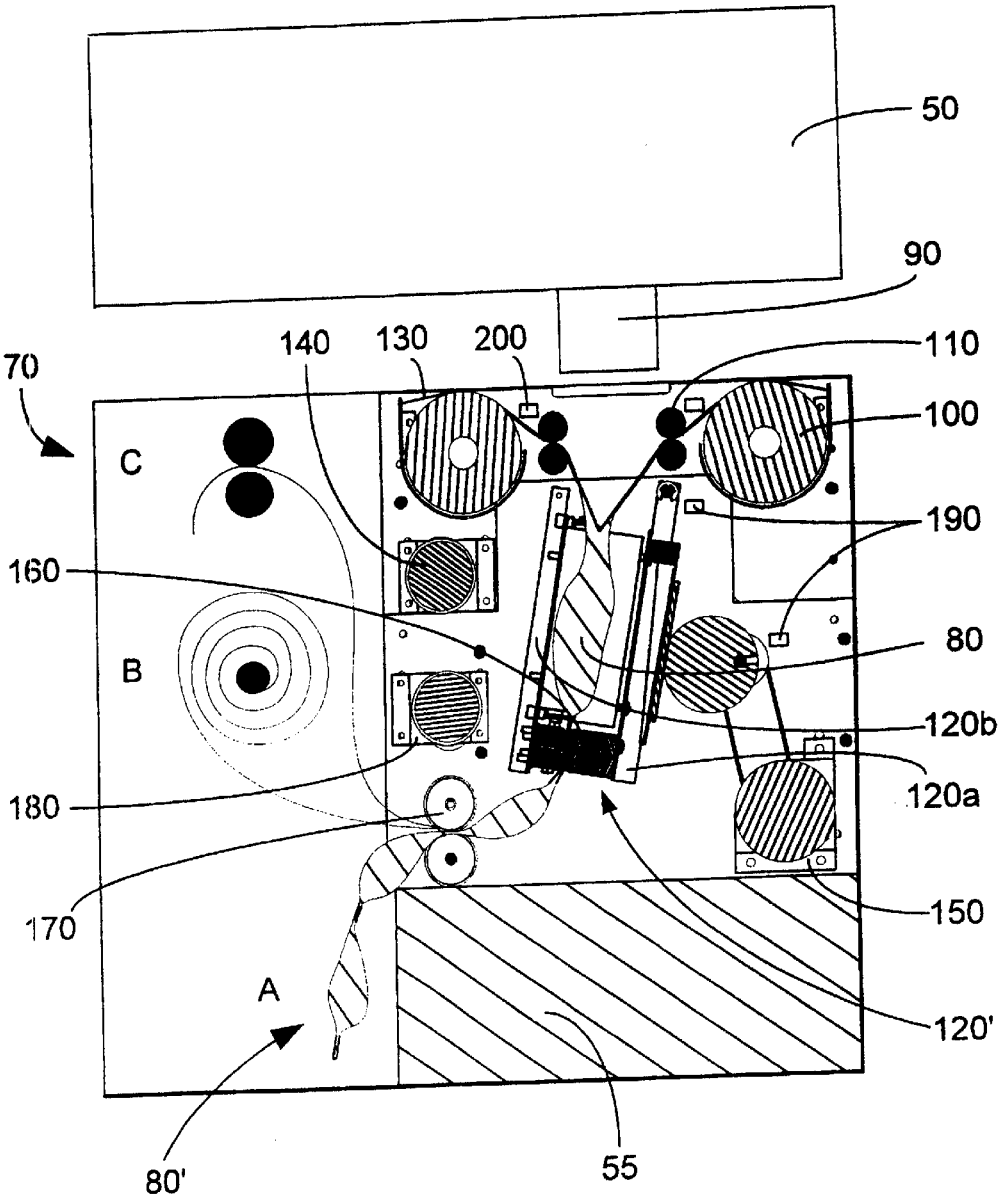
FIG. 6 is a front view in section of the main components in FIG. 2.
Figure 7:
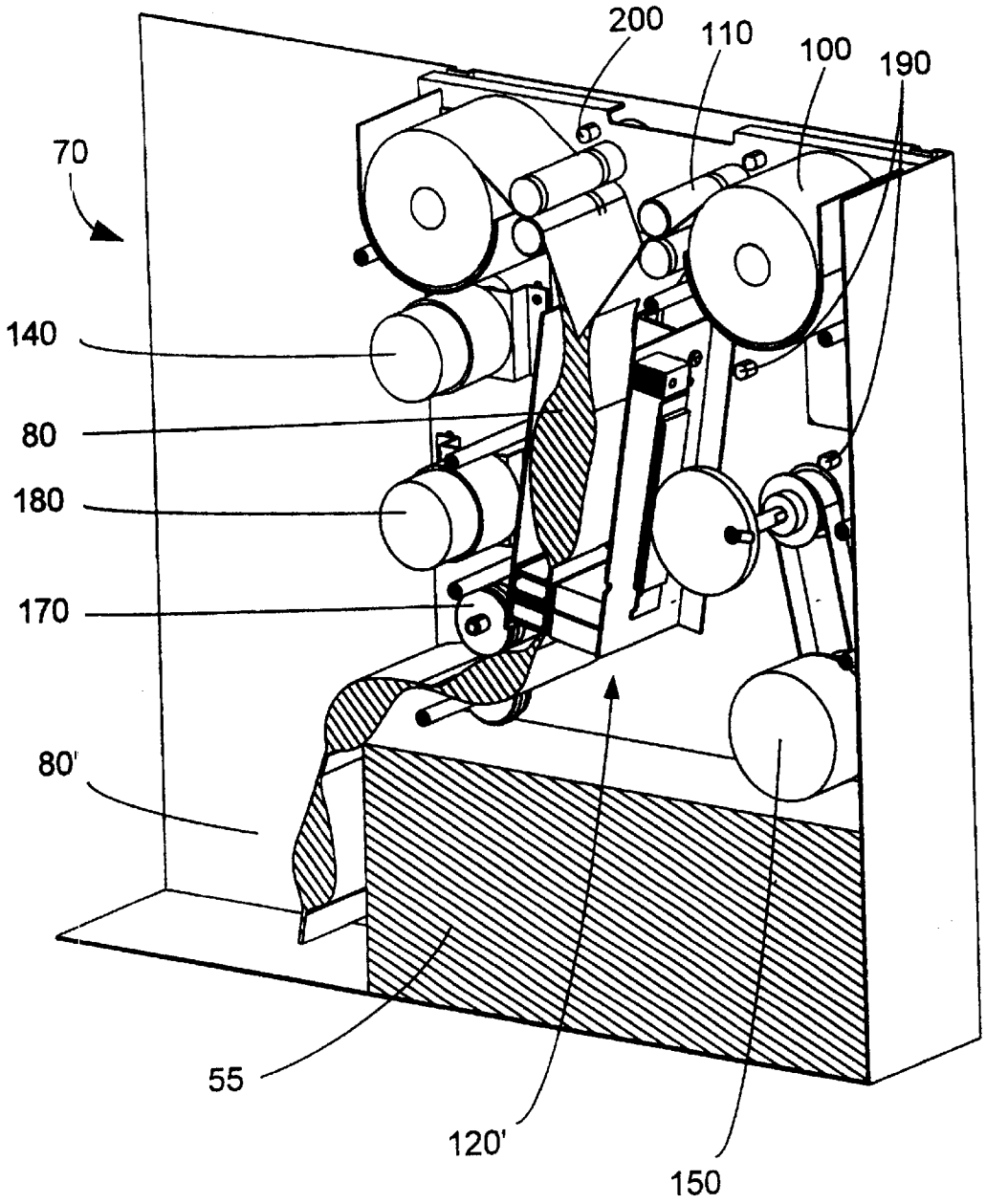
FIG. 7 is a perspective view in section of a coin packaging device of the coin processing apparatus shown in FIG. 6.

The construction of the coin processing apparatus 10, i e the coin separator 50 together with the coin packaging device 70, will be described with reference to FIGS. 6–11. In FIGS. 6 and 7, the coin packaging device 70 is shown in a position for sealing of a batch, in the following referred to as a plastic bag 80 filled with any number or types of coins 15. The coin packaging device 70 comprises the coin guide 90 in communication with the coin chute 19 for receiving coins from an outlet of the coin separator 50. A pair of foil storage units 100 is provided in the form of magazines for a respective roll of plastic foil. A pair of feeders 110 are provided for feeding a predetermined length of plastic foil from the respective foil storage unit 100 to a sealing jaw 120. The sealing jaw comprises two sealers, a first movable sealer 120*a* and a second fixed sealer 120*b* working as an anvil for the first sealer. A device 130, preferably in the form of two arms, one for each storage unit, for braking and measuring the amount of plastic foil is in contact with the storage units 100. The braking function is required for eliminating the risk of having the plastic foils rolling out unintentionally due to the moment of inertia for each storage unit during operation.

The sealers 120*a* and 120*b* are adapted to join the two plastic foils together so as to form the coin bag or sachet 80. As will be described in more detail later, the plastic foils are joined by resistive heating. Additionally, a drive assembly 140 is provided for moving the feeders 110. The first sealer 120*a* is moved by means of another drive mechanism 150. The first sealer 120*a* is movable from a first position 120' shown in FIGS. 6 and 7 to a second position 120" shown in FIGS. 8 and 9. In the first position 120' the sealing jaw 120 is closed so that a plastic bag 80 is formed by the plastic foils and may be filled with coins 15 delivered from the coin separator 50. The plastic foils are simultaneously perforated at a front part seen in the feeding direction of the bags by means of a knife 160. The knife is securely clamped between two fixed holder parts attached to the lower part of the first sealer 120*a*.

Figure 8:
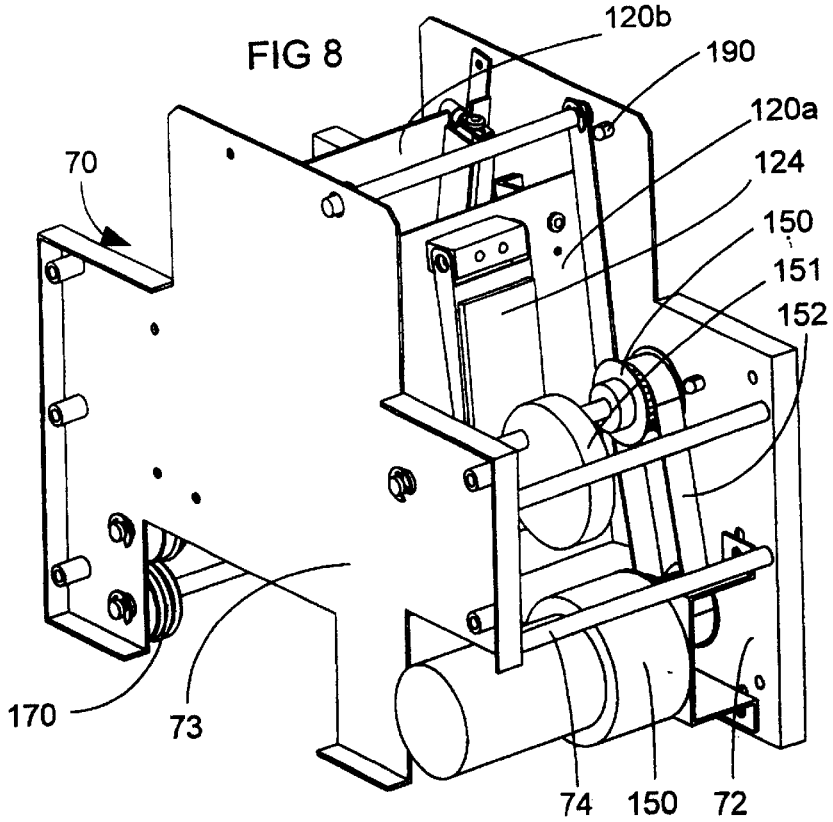
FIG. 8 is a perspective view of a bag-forming portion of the coin packaging device shown in FIG. 7.
Figure 9:
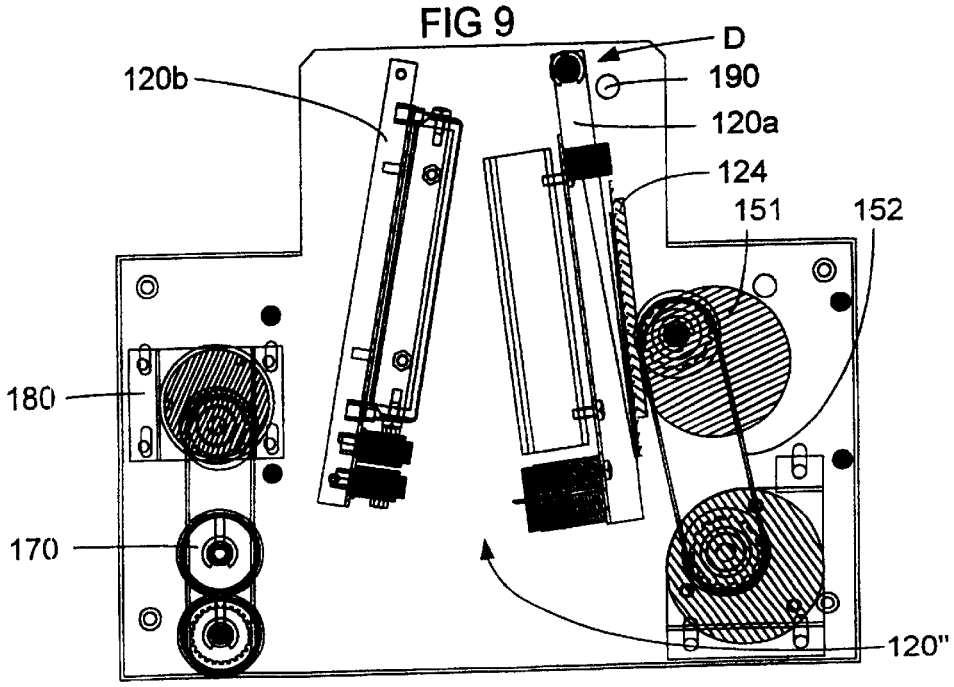
FIG. 9 is a front view in section of the bag-forming portion shown in FIG. 8.

In FIGS. 8 and 9 a part 71 of the coin packaging device 70 working as a bag-forming unit is shown. This bag-forming unit is a separate module detached from the coin packaging device. Here, in the second position 120", the sealing jaw 120 is opened for releasing the filled plastic bag 80 and ready to receive a new set of plastic foils and form a new plastic bag. Each filled plastic bag 80 is then fed into a final feeder mechanism 170 driven by a drive mechanism 180. The feeder mechanism has two functions, it feeds each plastic bag, which is attached to adjacent plastic bags forming a band 80' of plastic bags, and at the same time keeps the band of adjoined plastic bags sufficiently stretched for reducing the risk of band jams during the bag handling. The final feeder mechanism comprises two pair of rolls, a total of four rolls. The first pair of rolls is placed above the transport path for the plastic bags and the second pair of rolls is placed below the transport path. Each roll of the first top pair is separately suspended at one end to a frame, wherein each roll of the second pair of rolls is interconnected with each other at one end by an axle, over which the plastic bags move, and is suspended at the other end to the frame.

The plastic bags 80 may be supplied to an external machine, an external conveyor belt or an external storage area, represented by a position A. The plastic bags may also be more or less permanently stored by rolling them around a pin at a position B, or lifting them to a top position C, so that a larger storage area is achieved during the bag handling.

Figure 10:
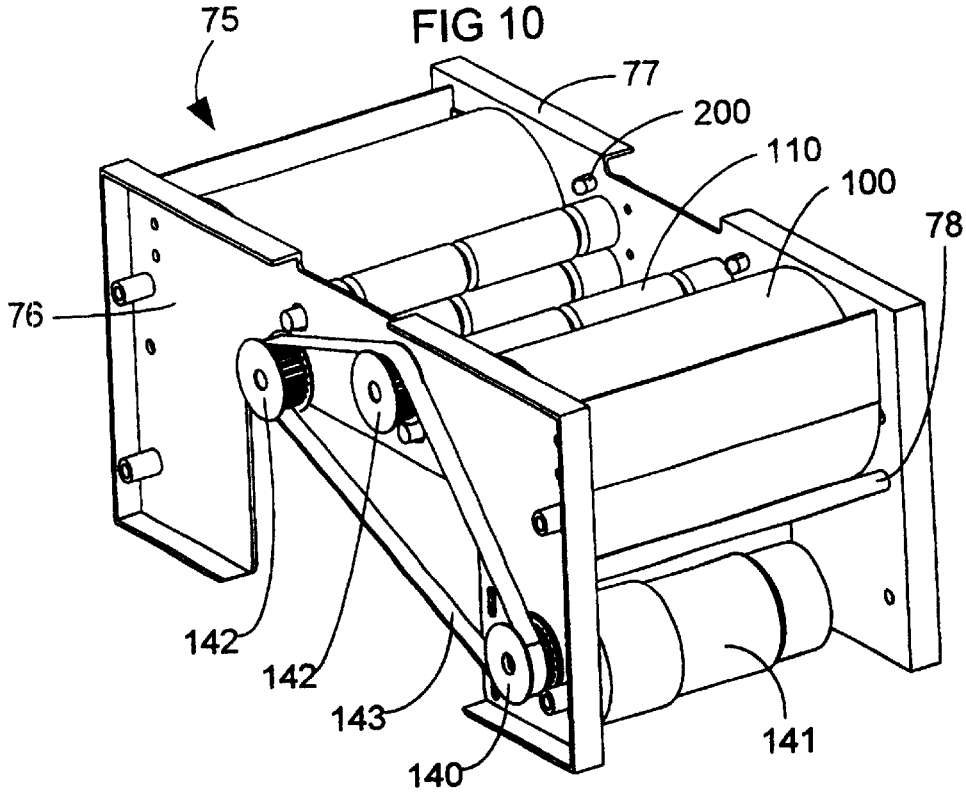
FIG. 10 is a perspective view of a bag-supplying portion of the coin packaging device shown in FIG. 6.
Figure 11:
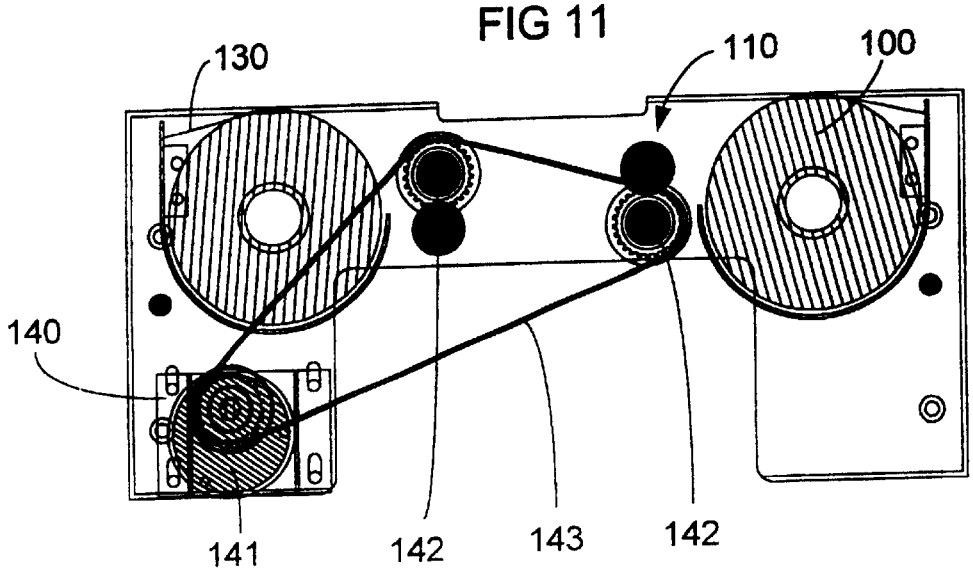
FIG. 11 is a front view in section of the bag-supplying portion shown in FIG. 10.

In FIGS. 10 and 11 the plastic foil storage units 100 are shown as a separate foil supplying unit 75, which is a separate module to be attached on top of the bag-forming unit 71. The drive assembly 140 of the plastic foil storage units comprises a motor 141, three wheels 142, and a belt 143 for transferring the torque of the motor axle to the pair of feeders 110 of the plastic foil storage units.

Figure 12:
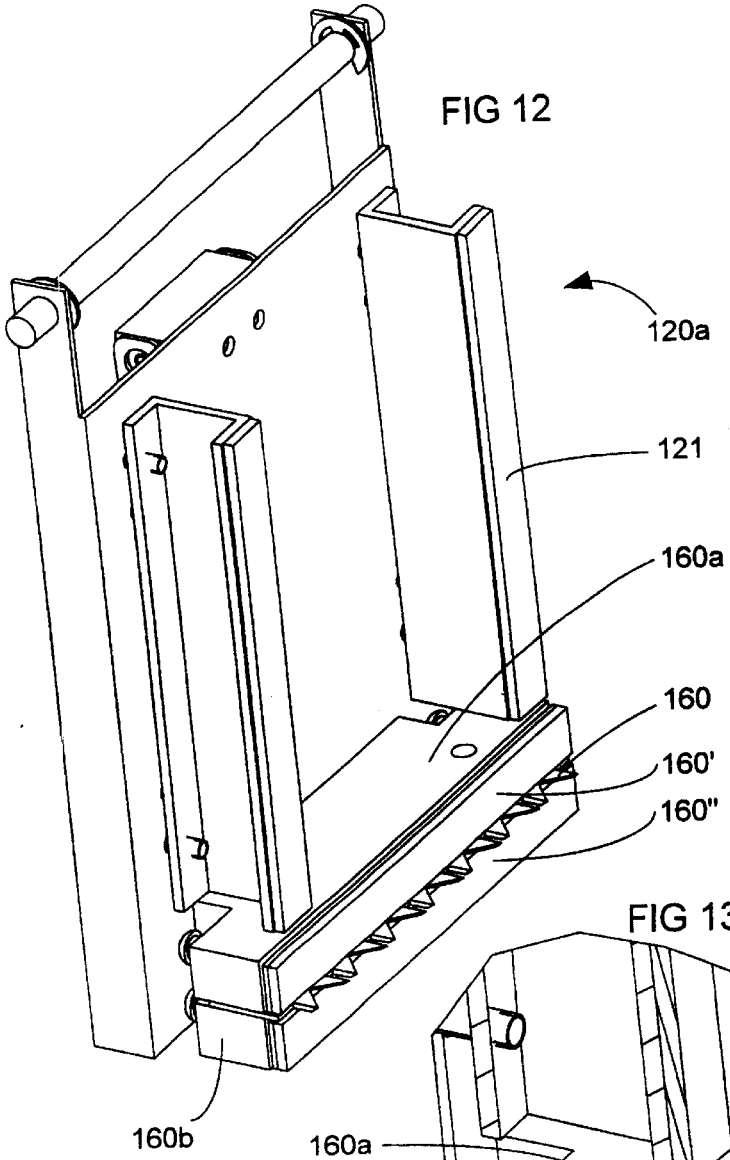
FIG. 12 is a perspective view of a first part of the bag-forming portion shown in FIG. 9.

FIG. 12 shows the first sealer 120*a* of the sealing jaw 120 in its first position, i e when it is pressed against the second sealer 120*b* (not shown), whereby the plastic foils forming the plastic bag 80 (not shown) is placed between the two sealers. Two front surfaces 160' and 160' of the perforating knife 160 is movable by way of a spring mechanism and is shown in a depressed state because of the anvil effect from the second sealer 120*b*. An essentially U-shaped press surface of the first sealer 120*a* is formed by two portions 121, which form the legs of the U and extend longitudinally in the feeding direction of the plastic foils, and the two front surfaces 160' and 160". When the two sealers are pressed together, the two front surfaces will be pushed in a direction towards the first sealer and reveal the perforating knife, whereby the knife 160 perforates the plastic foils.

Figure 13:
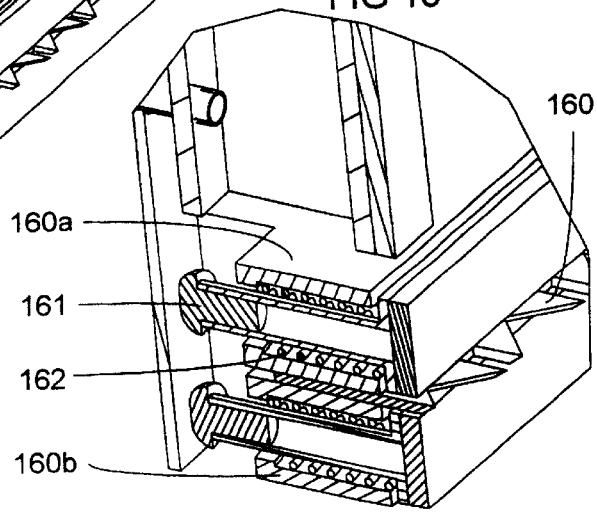
FIG. 13 is an enlarged view in section showing a portion of the first part shown in FIG. 12.

In FIG. 13 the spring mechanism for revealing the perforating knife 160 is shown more clearly in an enlarged scale. Each holder part 160*a* and 160*b* has movable front surfaces 160' and 160", respectively, in the form of a plate coated with silicone. Each front plate is attached to one end of a pin 161 protruding through a through hole in each holder part, and each pin 161 has a stop at the other end with an outer diameter larger than the inner diameter of the through hole. Each front plate 160' and 160" is integrated in the pin and attached perpendicularly to the pin. Each pin 161 is supported axially by a spring 162 enclosed in the through hole of each holder part, each spring being in contact with the interior of the associated fixed holder part at one end and in contact with the front surface 160' or 160" at the other end. The spring biases the adherent front surface in a direction perpendicular to the feeding direction of the plastic foils and bags 80 when the sealer jaw 120 is opened, i e when the first sealer 120*a* is moved away from the second sealer 120*b* in the first position 120' to the second position 120". Each pin 161 moves until it comes in contact with the holder part and stops, whereby both front surfaces 160' and 160" have passed past the edge of the knife 160 and cover it in the second open position 120" of the sealer jaw.

Various sensors 190 and 200 are provided in FIGS. 6–11 for indicating the current positions of the feeders 110 and the first movable sealer 120*a*.

Figure 14:
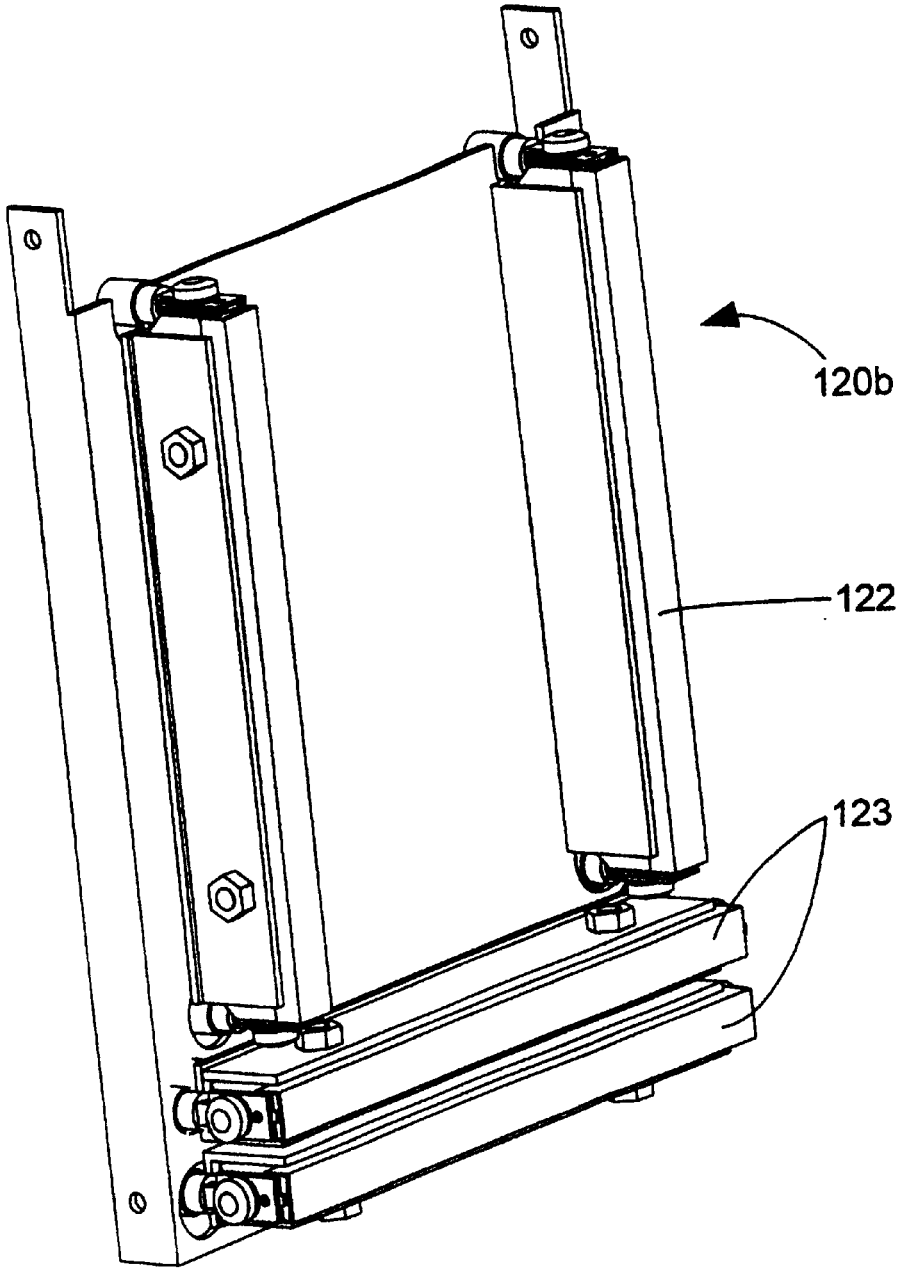
FIG. 14 is a perspective view of a second part of the bag-forming portion shown in FIG. 9.

FIG. 14 illustrates the second sealer 120*b* of the sealing jaw 120. The second sealer has two functions: firstly it forms a fixed anvil for the first sealer when the first sealer is pressed against it in the first position 120', and secondly it joins the two plastic foils by resistive welding, thereby forming and sealing the essentially U-shaped plastic bag 80. The second sealer has an essentially U-shaped press surface corresponding to the first sealer, which is formed by two portions 122 creating the legs of the U and two portions 123 corresponding to the front surfaces 160' and 160" of the first sealer 120*a*.

The coin packaging device 70 illustrated in FIGS. 6–11 has the following operating cycle:

The sealing jaw 120 formed by the sealers 120*a* and 120*b* is opened, as shown in FIG. 9, and a respective piece of plastic foil is hanging from the foil storage units 100 within the sealer jaw formed by the sealers.

The controller 11 in the coin separator 50 provides a control signal to the coin packaging device 70, instructing the latter to start preparing for coin packaging in accordance with a predetermined packaging scheme, involving a number of coins of a given type (currency, denomination), possibly together with another number of coins of a second type, etc.

The sealing jaw 120 formed by the sealers 120*a* and 120*b* is closed by moving the first sealer 120*a* into contact with the second sealer 120*b* as shown in FIGS. 6 and 7, whereby the plastic foils simultaneously is perforated by the knife 160.

The coin packaging device 70 provides a control signal to the controller 11 of the coin separator 50, thereby alerting that it is now time for the coin separator to start processing a plurality of coins, e g counting them. Simultaneously, the pieces of plastic foil provided from the foil storage units 100 are sealed to form a coin bag or sachet 80 by resistive welding.

The desired type and number of coins 15 are then supplied one by one down through the coin chute 19, and into the coin guide 90 of the coin packaging device 70 until the desired amount of coins has been filled into each coin bag 80.

The controller 11 of the coin separator 50 provides a control signal to the coin packaging device 70, thereby alerting the latter that the plurality of coins have now been counted. Simultaneously, the sealer jaw 120 is opened, i e the first sealer 120*a* is moved away from the second sealer 120*b*, thereby disengaging the filled and sealed plastic bag 80.

The feeders 110 feed a respective predetermined length of plastic foil from the foil storage units 100, whereby the plastic bag 80 simultaneously is fed out of the sealing jaw 120.

The coin packaging device 70 provides a control signal to the controller 11 of the coin separator 50, thereby alerting the latter that the coin packaging device is now ready to receive the plurality of coins from the outlet of the coin separator, through the coin chute 19 via the coin guide 90.

The essential parts of the coin packaging device 70 according to the preferred embodiment will now be described in more detail with reference to FIGS. 8–11.

FIG. 8 illustrates the bag-forming unit 71 of the coin packaging device 70 in the form of a module, on which the module of the foil-supplying unit 75 in FIGS. 10 and 11 is placed. The bag-forming unit comprises two frames 72 and 73, which function as support and attachment points for the other parts of the unit, such as motors, bearing sleeves, sensors, the final feeder mechanism 170, etc. Furthermore, the two frames are supported and held together by at least one rod 74.

FIGS. 10 and 11 illustrate the foil-supplying unit 75. The foil-supplying unit also has two frames 76 and 77, which function as support and attachment points for the other parts of the unit, such as motors, bearing sleeves, sensors, the feeders 110, etc. Furthermore, the two frames are supported and held together by at least one rod 78. According to the preferred embodiment, a transparent plastic LDPE foil is used having a width of 100 mm, a thickness of 0.07 mm, an inner diameter of 20 mm and an outer diameter of 60 mm. Each roll of foil contains approximately 35.5 m of plastic foil. The foil rolls are placed in holders with the brake and indicator device 130 in contact with each foil roll. The device 130 has, as mentioned earlier, two purposes; to dispense foil and to prevent undesired or unexpected foil feeding.

The feeders 110 have the form of a pair of rollers. The pair of rollers are provided with a number of resilient rings, preferably rubber rings, which interact with each other and create enough friction for feeding the predetermined length of plastic foil from a respective one of the foil storage units 100. A respective pair of rollers is provided for each foil storage unit 100. The four rolls of the final feeder mechanism 170 are provided with the same resilient rings as the feeders 100 for the same purpose.

The rollers are driven by belt through a 24 VDC motor with a torque of 0.03 Nm and an angular frequency of 110 rpm. The tension of the belt is regulated by an appropriate design of the motor attachment points known to a man skilled in the art.

The predetermined length of plastic foil is fed through the feeders 110 and is detected by means of a foil sensor. The foil sensor comprises a slotted optical switch and a perforated disk, which is attached to one of the driven rollers.

The sealer jaw 120 formed by the first sealer 120*a* and the second sealer 120*b* is actuated by the drive mechanism 150 comprising a motor that drives a cam 151 via a transmission 152. The cam has an essentially circular shape and is eccentrically attached to an axle that is driven by the transmission. The drive mechanism, i e the motor, the cam and the transmission, presses against a plate 124 of the first sealer 120*a* towards the second sealer 120*b*, whereby the first sealer moves by rotating around point D in FIG. 9 towards the second sealer. When the foil is thus placed within the sealer jaw, the plastic coin bag 80 or sachet is sealed. The plate 124 is attached to the first sealer 120*a* and works as a contact surface for the cam 151. The plate is suspended by a spring mechanism to compensate for any tolerance differences between the cam and the plate. The spring mechanism of the plate also smoothens the engaging and disengaging of the cam when actuating the first sealer 120*a*. The perforator knife 160 creates holes in a section between two subsequent bags, making it easy later on for a human user to separate two adjacent plastic bags from each other-by tearing them apart. Sealing and perforation occur when the plastic coin bag is filled with coins 15 through the coin guide 90.

The heater in the second sealer 120*b* comprises a kanthal resistance wire stringed on bakelite blocks. The press surfaces 122 and 123 are designed of silicon pads, which are attached to aluminium blocks as in the first sealer 120*a*. Both types of blocks are attached to a frame and form the U character, as shown in more detail in FIGS. 12–14.

The perforator 160 comprises about 5–30 knives, which are attached to the holder parts 160*a* and 160*b*, as shown in FIGS., 12 and 13.

The drive mechanism 150 is illustrated in FIGS. 8 and 9 and is designed to operate the sealer jaw 120 formed by the press surfaces of the sealers 120*a* and 120*b*. The drive mechanism provides the sealer jaw with a high welding pressure and renders the sealer jaw very compact and space efficient. Micro sensors are used for indicating the current position of the sealer jaw. The sealer jaw is illustrated in the closed position in FIGS. 2, 6 and 7 and in the opened position in FIGS. 8 and 9. The transmission in the form of a belt 152 of the drive mechanism transmits torque from the motor to the cam 151. Because of the fairly high torque required for the sealer jaw in order to produce enough welding pressure, and because of the frequent changes in direction, the drive mechanism is designed appropriately. The motor chosen is a 24 VDC motor having a torque of 0.98 Nm and an angular frequency of 17 rpm.

The welding and bag-forming cycle for one bag 80 takes, preferably, between 7–15 seconds, more preferably between 2–10 seconds and most preferably between 1–7 seconds. The foil storage capacity is >300 bags but may be less or more depending on each bag size and/or the coin size. The packaging capacity in number of coins is, preferably, >(100–300) coins per minute and most preferably >350 coins per minute.

Moreover, the coin packaging device 70 comprises appropriate control logic circuitry 55, which are only schematically illustrated as a square unit in FIGS. 6 and 7. The control logic circuitry is adapted to generate various control signals to the different parts of the coin packaging device, as well as to communicate with the controller 11 of the coin separator 50. Preferably, the control logic circuitry is implemented as a CPU, micro controller, etc having appropriate memories as well as input and output means.

The present invention has been described above with reference to a preferred embodiment. However, other embodiments than the one illustrated above are equally applicable within the scope of the invention, as defined by the appended independent claim, as is readily realized by a man skilled in the art.

In particular, it is to be observed that the invention applies also to items, which are structurally similar to coins, such as disks, markers, tokens, etc. Moreover, the coin packaging device 70 is constructed by modules, i e in separate units like the control logic circuitry unit 55, the bag-forming unit 71, and the foil-supplying unit 75, for simplifying the implementation of new developments and design changes. The module structure also facilitates the mounting and maintenance procedure of the coin packaging device 70.

Additionally, other thin foil materials than plastic foils may be used as packaging material for the coin bags.

I claim:

1. A coin processing apparatus, comprising:

an opening for receiving a plurality of coins of different types;

a coin sensor adapted to determine a respective type of individual coins among the plurality of coins;

a controller operatively coupled to the coin sensor;

a coin separator operatively coupled to the controller and capable of separating the individual coins from the plurality of coins under control from the controller;

a coin packaging device, comprising:

a coin inlet;

a supply of packaging material; and a packaging mechanism capable of producing a plurality of coin bags from the supply, wherein the coin inlet is coupled to the coin separator so as to receive the individual coins therefrom, the packaging mechanism is adapted to enclose the individual coins in any of the coin bags, the controller is adapted to control the packaging mechanism according to a specified packaging scheme, so that at least two different coin types are packaged in the coin bags in a continuous operation.

2. A coin processing apparatus according to claim 1, wherein the packaging mechanism is adapted to produce a continuous sequence of coin bags, and wherein adjacent coin bags are physically joined by a perforated portion of the packaging material.

3. A coin processing apparatus according to claim 1, wherein the packaging material is a plastic material.

4. A coin processing apparatus according to claim 1, wherein the different coin types relate to different coin denominations.

5. A coin processing apparatus according to claim 1, wherein the different coin types relate to different currencies.

6. A coin processing apparatus according to claim 1, wherein the packaging mechanism is a bag forming unit comprising a sealer jaw having a first movable sealer and a second movable sealer, the first sealer being movable from a first position in which the sealer jaw is closed to a second position in which the sealer jaw is open.

7. A coin processing apparatus according to claim 6, wherein the first sealer is actuated by an eccentrically shaped actuator, which engages and disengages against a contact surface on the first sealer, the contact surface being flexible to compensate for tolerance differences between the first sealer and the actuator.

8. A coin processing apparatus according to claim 1, wherein the supply of packaging material is controlled by a drive mechanism and an indicator device, the indicator device working as a brake for the supply and as an indicator for the amount of packaging material left in the supply.

9. A coin processing apparatus according to claim 1, wherein the coin separator is adapted for sorting and/or counting a plurality of coins, the separator comprising:

a circular sorting path with at least one off-sort station;

a first rotatable means with a first surface;

a second rotatable means with a second surface, the first and second surfaces being arranged to rotate at essentially the same speed and being arranged to engage the coins there between, thereby transporting the coins along the circular sorting path.

10. A coin processing apparatus according to claim 9, wherein the first rotatable means is a rotating disk, to which the plurality of coins are deposited prior to the processing thereof.

11. A coin processing apparatus according to claim 9, wherein the second rotatable means is provided with resilient means for frictional engagement with the first surface of the first rotatable means and with the coins.

12. A coin processing method, comprising the steps of:

receiving a plurality of coins of different type;

determining a respective type for individual coins among the plurality of coins;

separating the individual coins from the plurality of coins in response to the determined type;

producing a plurality of coin bags from a packaging material;

enclosing the individual coins in any of the coin bags in a way so that at least two different coin types are packaged in the coin bags in a continuous operation.

13. A coin processing method according to claim 12, wherein the coin bags are produced in a physically continuous sequence and wherein a perforation is made at an intermediate portion of the packaging material between adjacent coin bags.

14. A coin processing method according to claim 12, wherein a first number of coins of a first denomination or currency are packaged in a first bag, and a second number of coins of a second denomination or currency are packaged in a second bag.

15. A coin processing method according to claim 12, wherein a first number of coins of a first denomination or currency are packaged together with a second number of coins of a second denomination or currency in the same bag.

* * * * *